US010276994B2

(12) United States Patent
Su et al.

(10) Patent No.: US 10,276,994 B2
(45) Date of Patent: Apr. 30, 2019

(54) POWER LINE ASSEMBLY AND ELECTRONIC DEVICE USING SAME

(71) Applicants: Xiaomi Inc., Beijing (CN); Beijing Smartmi Technology Co., Ltd., Beijing (CN)

(72) Inventors: Jun Su, Beijing (CN); Yuya Omoto, Beijing (CN); Yi Wang, Beijing (CN); Mengnan Wang, Beijing (CN)

(73) Assignees: Xiaomi Inc., Beijing (CN); Beijing Smartmi Technology Co., Ltd., Beijing (CN)

( * ) Notice: Subject to any disclaimer, the term of this patent is extended or adjusted under 35 U.S.C. 154(b) by 0 days.

(21) Appl. No.: 15/792,055

(22) Filed: Oct. 24, 2017

(65) Prior Publication Data

US 2018/0048102 A1 Feb. 15, 2018

Related U.S. Application Data

(63) Continuation of application No. PCT/CN2016/083414, filed on May 26, 2016.

(30) Foreign Application Priority Data

May 28, 2015 (CN) ..... 2015 1 0282687

(51) Int. Cl.
*H01R 13/60* (2006.01)
*H01R 24/68* (2011.01)
(Continued)

(52) U.S. Cl.
CPC ..... *H01R 24/68* (2013.01); *F04D 19/002* (2013.01); *F04D 25/0673* (2013.01);
(Continued)

(58) Field of Classification Search
CPC .... H01R 11/30; H01R 11/00; H01R 13/6205; H01R 31/06
(Continued)

(56) References Cited

U.S. PATENT DOCUMENTS 5,941,729 A * 8/1999 Sri-Jayantha ..... H01R 13/6205 439/289
7,311,526 B2 * 12/2007 Rohrbach ..... H01R 13/6205 439/39
(Continued)

FOREIGN PATENT DOCUMENTS

CN 1447481 A 10/2003
CN 200944485 Y 9/2007
(Continued)

OTHER PUBLICATIONS

Extended European Search Report issued in European Patent Application No. 16799330.2, mailed from the European Patent Office, dated Dec. 13, 2017.
(Continued)

*Primary Examiner* — Hien D Vu
(74) *Attorney, Agent, or Firm* — Finnegan, Henderson, Farabow, Garrett & Dunner LLP

(57) ABSTRACT

The present disclosure relates to a power line assembly and an electronic device using the power line assembly. The power line assembly may include: a power line; a power plug disposed at a first end of the power line and configured to couple with a power outlet; and a power line base disposed at a second end of the power line and having a top surface and a bottom surface, each of the top and bottom surfaces having one or more power-delivery contacts, wherein when the power line base couples with a power-receiving assembly of an electronic device, at least one of the power-delivery contacts contacts with a power-receiving
(Continued)

contact of the power-receiving assembly, to deliver power to the electronic device.

9 Claims, 9 Drawing Sheets

(51) Int. Cl.

| | |
|---|---|
| ***F04D 19/00*** | (2006.01) |
| ***F04D 25/08*** | (2006.01) |
| ***F04D 29/60*** | (2006.01) |
| ***H01R 13/62*** | (2006.01) |
| ***H01R 13/629*** | (2006.01) |
| ***F04D 25/06*** | (2006.01) |
| *H01R 13/22* | (2006.01) |
| *H01R 24/38* | (2011.01) |
| *H01R 103/00* | (2006.01) |

(52) U.S. Cl.
CPC ..... *F04D 25/0693* (2013.01); *F04D 25/08* (2013.01); *F04D 29/601* (2013.01); *H01R 13/6205* (2013.01); *H01R 13/629* (2013.01); *H01R 13/22* (2013.01); *H01R 24/38* (2013.01); *H01R 2103/00* (2013.01)

(58) Field of Classification Search
USPC ..... 439/38–40, 502
See application file for complete search history.

(56) References Cited

U.S. PATENT DOCUMENTS

| | | | | |
|---|---|---|---|---|
| 7,963,774 | B2 * | 6/2011 | Shiff ..... | H01R 13/6205 439/38 |
| 8,894,419 | B1 * | 11/2014 | Buelow ..... | H01R 13/6205 439/218 |
| 2013/0164949 | A1 | 6/2013 | Riering-Czekalla et al. | |

FOREIGN PATENT DOCUMENTS

| | | | |
|---|---|---|---|
| CN | 201592666 | U | 9/2010 |
| CN | 202308439 | U | 7/2012 |
| CN | 103023077 | A | 4/2013 |
| CN | 103326169 | A | 9/2013 |
| CN | 103356064 | A | 10/2013 |
| CN | 203263049 | U | 11/2013 |
| CN | 203978888 | U | 12/2014 |
| CN | 204061242 | U | 12/2014 |
| CN | 104577569 | A | 4/2015 |
| CN | 204632973 | U | 9/2015 |
| CN | 104852182 | A | 8/2016 |
| EP | 2533374 | A1 | 12/2012 |
| JP | H 8-33214 | A | 2/1996 |
| JP | 2000-324220 | A | 11/2000 |
| JP | 3164427 | U | 11/2010 |
| JP | 2014-92054 | A | 5/2014 |
| KR | 20-1990-0003688 | Y1 | 4/1990 |
| RU | 2474020 | C2 | 1/2013 |
| WO | WO 2011/013602 | A1 | 2/2011 |
| WO | WO 2011/137949 | A1 | 11/2011 |

OTHER PUBLICATIONS

International Search Report of PCT/CN2016/083414, mailed from the State Intellectual Property Office of China dated Aug. 22, 2016.
Office Action for Chinese Application No. 201510282687.7, mailed from the State Intellectual Property Office of China dated Aug. 30, 2016.
Office Action for RU Application No. 2016128946/07 dated Jan. 30, 2018.
Office Action for RU Application No. 2016128946/07 dated Jun. 21, 2018.

* cited by examiner

POWER LINE ASSEMBLY AND ELECTRONIC DEVICE USING SAME

CROSS-REFERENCE TO RELATED APPLICATIONS

This application is a continuation of International Application No. PCT/CN2016/083414, filed May 26, 2016, which is based on and claims priority to Chinese Patent Application No. 201510282687.7, filed May 28, 2015, the entire contents of all of which are incorporated herein by reference.

TECHNICAL FIELD

The present disclosure generally relates to the technical field of electronic devices, and, more particularly, to a power line assembly and an electronic device using the power line assembly.

BACKGROUND

Electronic devices are used in various corners of people's daily life. For example, as an essential appliance, an electric fan uses a motor to drive the rotation of fan blades, so as to cause air circulation and make users feel cool. Often, an electronic device is equipped with a power line, which can be inserted into an electric outlet for delivering power to the electronic device.

SUMMARY

According to a first aspect of the present disclosure, there is provided a power line assembly, comprising: a power line; a power plug disposed at a first end of the power line and configured to couple with a power outlet; and a power line base disposed at a second end of the power line and having a top surface and a bottom surface, each of the top and bottom surfaces having one or more power-delivery contacts, wherein when the power line base couples with a power-receiving assembly of an electronic device, at least one of the power-delivery contacts contacts with a power-receiving contact of the power-receiving assembly, to deliver power to the electronic device.

According to a second aspect of the present disclosure, there is provided an electronic device for use with a power line assembly, the electronic device comprising: a battery; and a power-receiving assembly comprising: a power-receiving contact, and a first connection structure configured to affix the power-receiving assembly to a power line base of the power line assembly by coupling with a second connection structure located on a first surface of the power line base, the first surface being a top surface or a bottom surface of the power line base, wherein when the power-receiving assembly is coupled with the power line base, the power-receiving contact contacts with a power-delivery contact located on the first surface of the power line base, to receive power from the power line assembly.

According to a third aspect of the present disclosure, there is provided an electronic device for use with a power line assembly, the electronic device comprising: a battery; and a power-receiving assembly comprising: a power-receiving contact, and a first connection structure, wherein the power-receiving assembly is configured to couple with a power line base of the power line assembly; when the electronic device is operated in an affixing mode, the first connection structure affixes the power-receiving assembly to the power line base by coupling with a second connection structure formed on a first surface of the power line base, and the power-receiving contact contacts with a power-delivery contact on the first surface of the power line base to receive power from the power line assembly; and when the electronic device is operated in a touch mode, the power-receiving assembly contacts with a second surface of the power line base to connect the power-receiving assembly and the power line base, and the power-receiving contact contacts with a power-delivery contact on the second surface of the power line base to receive power from the power line assembly.

It is to be understood that the forgoing general description and the following detailed description are exemplary and illustrative only, and are not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which same numbers in different drawings represent the same or similar elements unless otherwise described. The implementations set forth in the following description of exemplary embodiments do not represent all implementations consistent with the present disclosure. Instead, they are merely examples of devices and methods consistent with aspects related to the present disclosure as recited in the appended claims.

It should be understood that the technical solutions of the present disclosure may apply to all types of electronic devices, and the present disclosure is not intended to limit the types of applicable electronic devices. Solely for the purpose of illustration, "an electric fan" or "an electric fan frame" is used as an example of "an electronic device" in the following embodiments.

Figure 1:
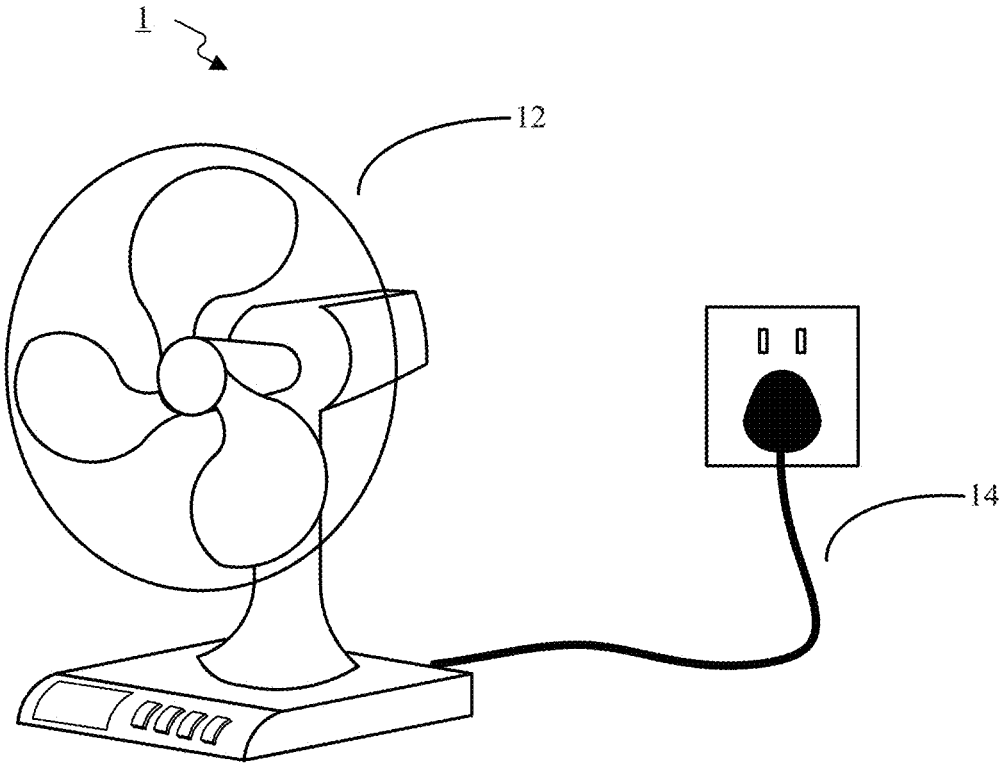
FIG. 1 (PRIOR ART)
FIG. 1 is a schematic diagram of an electric fan in related arts.

FIG. 1 is a schematic diagram of an electric fan 1 in related arts. As shown in FIG. 1, the electric fan 1 may include an electric fan frame 12 and a power line assembly 14. For example, the electric fan frame 12 is the main body of the electric fan 1 other than the power line assembly 14. The power line assembly 14 is directly connected to the electric fan frame 12, for example, to a bottom rear side of the electric fan frame 12. When a power plug of the power line assembly 14 is inserted into a power outlet, power can be supplied to the electric fan frame 12 to drive the rotation of the fan blades of the electric fan frame 12.

However, because the power line assembly 14 is directly connected to the electric fan frame 12, the space range in which the electric fan 1 can be used is fixed by the length of the power line assembly 14 and the position of the power plug.

The present disclosure solves the above-identified problem by improving the structure of an electric fan, including the structures of the electric fan frame and the power line assembly. Exemplary embodiments will be illustrated in the following in connection with FIGS. 2-9.

Figure 2:
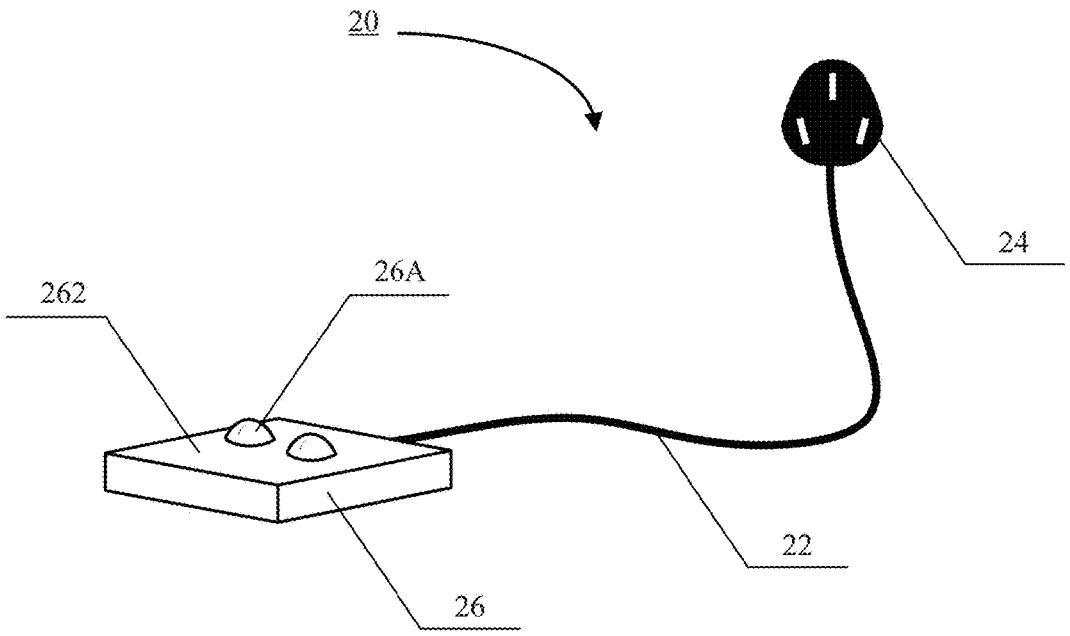
FIG. 2 is a schematic diagram illustrating a power line assembly, according to an exemplary embodiment of the present disclosure.

FIG. 2 is a schematic diagram illustrating a power line assembly 20, according to an exemplary embodiment of the present disclosure. As shown in FIG. 2, the power line assembly 20 may include a power line 22, a power plug 24 disposed at one end of the power line 22 for coupling with a power outlet (not shown), and a power line base 26 disposed at the other end of the power line 22. The power line base 26 has a top surface and a bottom surface, each of which may include one or more power-delivery contacts. For example, as shown in FIG. 2, the power line base 26 has a top surface 262, and power-delivery contacts 26A are disposed on the top surface 232.

Figure 3:
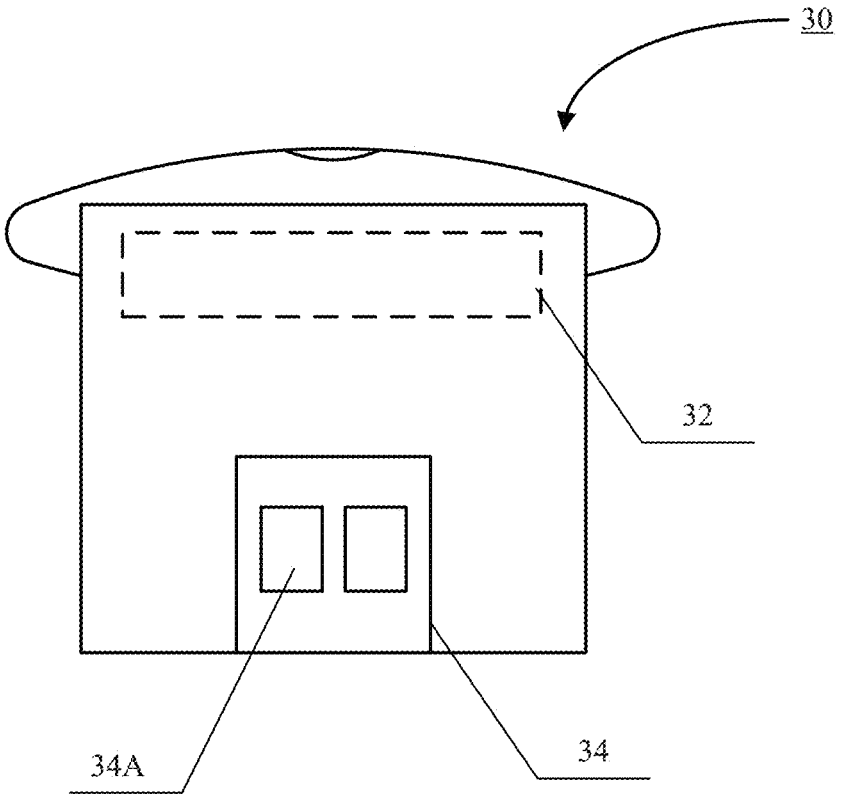
FIG. 3 is a schematic diagram illustrating a bottom of an electric fan frame, according to an exemplary embodiment of the present disclosure.

FIG. 3 is a schematic diagram illustrating an electric fan frame 30, according to an exemplary embodiment of the present disclosure. For example, the electric fan frame 30 may be used in conjunction with the power line assembly 20 (FIG. 2). As shown in FIG. 3, the electric fan frame 30 may include a built-in battery 32 and a power-receiving assembly 34. The power-receiving assembly 34 further includes one or more power-receiving contacts 34A. The power-receiving contacts 34A may be configured to contact with the power-delivery contacts (e.g., power-delivery contacts 26A) located on the top surface or the bottom surface of the power line base 26, when the power-receiving assembly 34 is coupled with the power line base 26. This way, the power line assembly 20 can deliver power to the electric fan frame 30.

As illustrated by FIGS. 2 and 3, in the technical solutions provided by the present disclosure, a power line assembly and an electric fan frame may be physically separate from each other.

Consistent with the disclosed embodiments, the electric fan frame 30 may support two different power-supply modes.

In the first power-supply mode, a user may couple the electric fan frame 30 (or more specifically, the power-receiving assembly 34) with the power line assembly 20, for example, by placing the electric fan frame 30 on the power line base 26. This way, the power-delivery contacts 26A may contact with the power-receiving contacts 34A, so as to deliver power to the electric fan frame 30.

Figure 4:
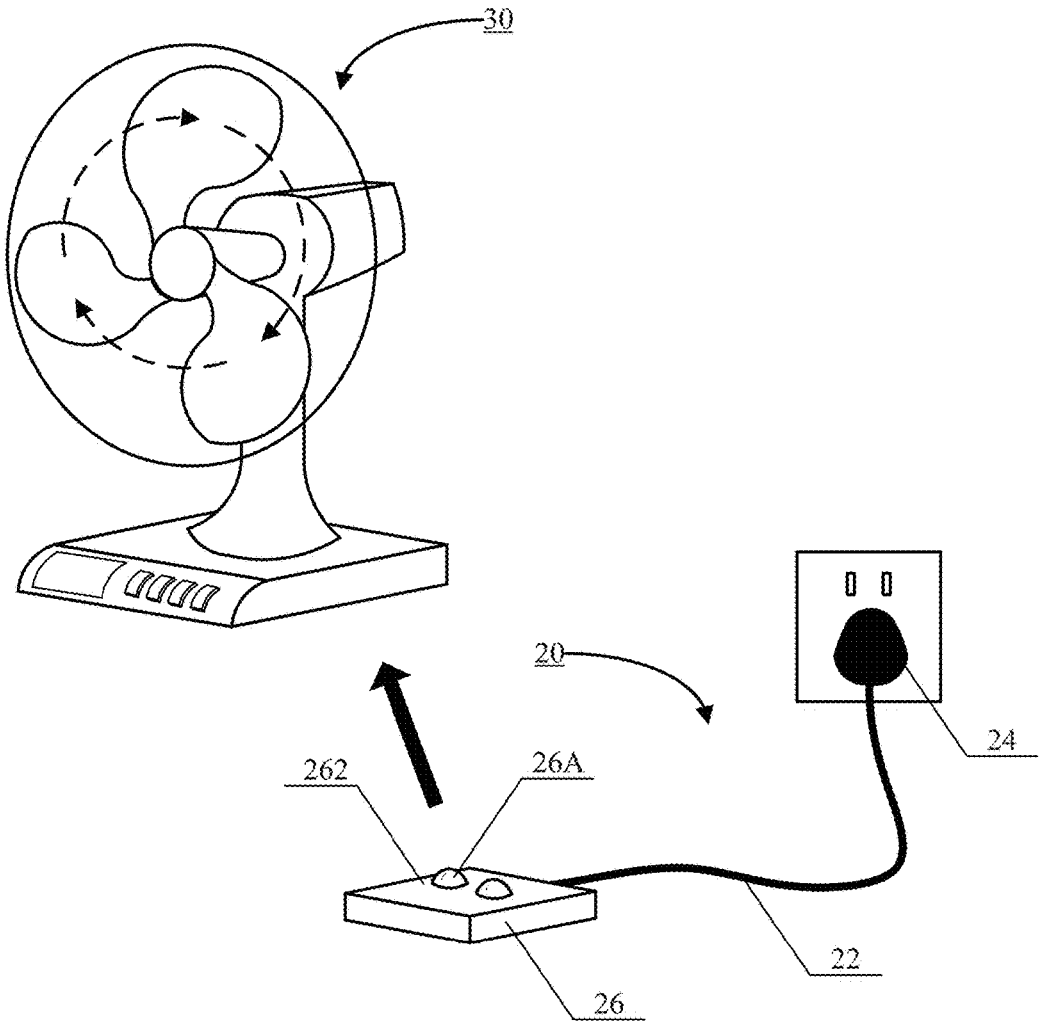
FIG. 4 is a schematic diagram illustrating an electric fan frame and a power line assembly that are separated from each other, according to an exemplary embodiment of the present disclosure.

In the second power-supply mode, when the electric fan frame 30 is used outside the space range which the power line assembly 20 can reach, a user may detach the electric fan frame 30 from the power line assembly 20 and use the built-in battery 32 to power the electric fan frame 30. FIG. 4 is a schematic diagram illustrating an electric fan frame 30 and a power line assembly 20 separated from each other, according to an exemplary embodiment of the present disclosure. Referring to FIG. 4, the electric fan frame 30 may operate on the power output by the built-in battery 32, such that the use of the electric fan frame 30 is not limited to the area reachable by the power line assembly 20.

The following description provides more details about various components of the power line assembly 20 and the electric fan frame 30, consistent with the disclosed embodiments.

1. Power-Delivery Contacts 26A and Power-Receiving Contacts 34A

In the disclosed embodiments, power may be supplied to the electric fan frame 30 through physical contact between the power line assembly 20 and the electric fan frame 30. For example, the power-delivery contacts 26A shown in FIG. 2 and the power-receiving contacts 34A shown in FIG. 3 may be employed to form the contact between the power line assembly 20 and the electric fan frame 30. This way of power delivery may help to reduce the resisting force involved in combining the electric fan frame 30 with the power line assembly 20 and/or detaching the electric fan frame 30 from the power line assembly 20, and thus make it more convenient for a user to achieve the combining and/or detaching. For example, a user who is standing may directly lift the electric fan frame 30 from the power line base 26, or place the electric fan frame 30 on the power line base 26, without stooping down to check the connection or do the combining/detaching manually.

In some embodiments, to ensure the contact between the power-delivery contacts 26A and the power-receiving contacts 34A, the power-delivery contacts 26A may be formed by bulging from the top surface and/or the bottom surface on which the power-deliver contacts 26A are located. Moreover, the power-delivery contacts 26A may have a partially spherical shape, e.g., a hemispherical shape as shown in FIG. 2. Correspondingly, the power-receiving contacts 34A may be in the form of a metal sheet as shown in FIG. 3.

The above-described shapes of the power-delivery contacts 26A and the power-receiving contacts 34A are for illustrative purpose only. The present disclosure does not limit the shapes of the power-delivery contacts 26A or the power-receiving contacts 34A. Moreover, the electric fan frame 30 may employ a non-contact manner to receive power from the power line assembly 20, which is also not limited by the present disclosure.

2. Power-Receiving Assembly 34

Figure 5:
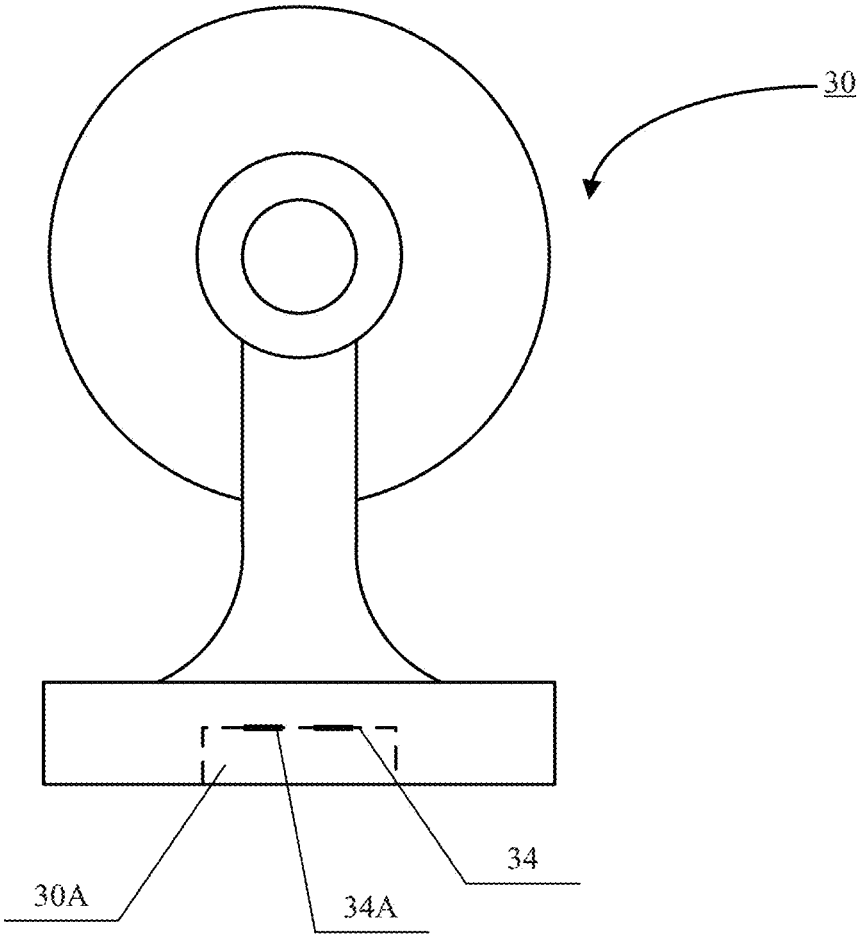
FIG. 5 is a schematic diagram illustrating a back side of an electric fan frame, according to an exemplary embodiment of the present disclosure.

FIG. 5 is a schematic diagram illustrating a back side of an electric fan frame 30, according to an exemplary embodiment of the present disclosure. As shown in FIG. 5, the bottom of the electric fan frame 30 may be recessed to form an accommodation space 30A to receive the power line base 26. The power-receiving assembly 34, including the power-receiving contacts 34A, may be disposed on the ceiling of the accommodation space 30A. To couple the electric fan frame 30 with the power line assembly 20, a user may place or "hide" the power line base 26 in the accommodation space 30A. Guided by the structural limitation provided by the accommodation space 30A, the user can conveniently make the power-delivery contacts 26A contact with the power-receiving contacts 34A, without deliberate alignment.

The above-described use of the accommodation space 30A is for illustrative purpose only. The present disclosure does not limit the way of forming the contact between the power-delivery contacts 26A and the power-receiving contacts 34A. For example, in some embodiments, the bottom of the electric fan frame 30 has no recessed structure. Instead, the power-receiving assembly 34 is directly formed on the bottom of the electric fan frame 30. In this case, a user may directly place the electric fan frame 30 on the power line base 26 to couple the electric fan frames 30 with the power line assembly 20.

Figure 6:
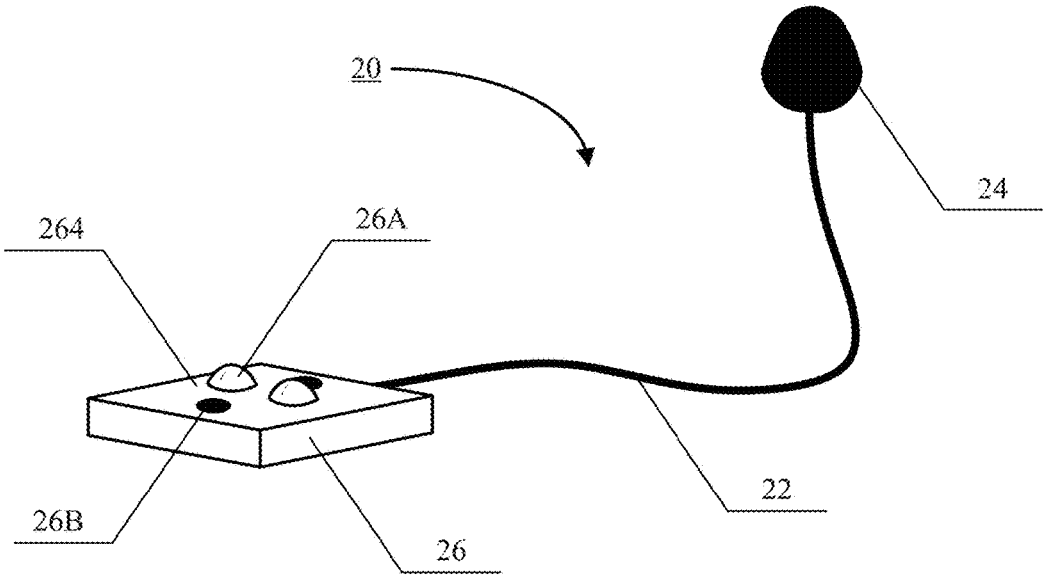
FIG. 6 is a schematic diagram illustrating a power line assembly, according to an exemplary embodiment of the present disclosure.

FIG. 6 is a schematic diagram illustrating a power line assembly 20, according to an exemplary embodiment of the present disclosure. As shown in FIG. 6, in addition to the components shown in FIG. 2, the power line assembly 20 may further include a first connection structure 26B disposed on at least one of the top surface and the bottom surface of the power line base 26. For example, as illustrated in FIG. 6, the first connection structure 26B may be disposed on a bottom surface 264 of the power line base 26. That is, the top surface 232 shown in FIG. 2 may be only equipped with one or more power-delivery contacts 26A, while the bottom surface 264 shown in FIG. 6 may be equipped with both the power-delivery contacts 26A and the first connection structure 26B.

Figure 7:
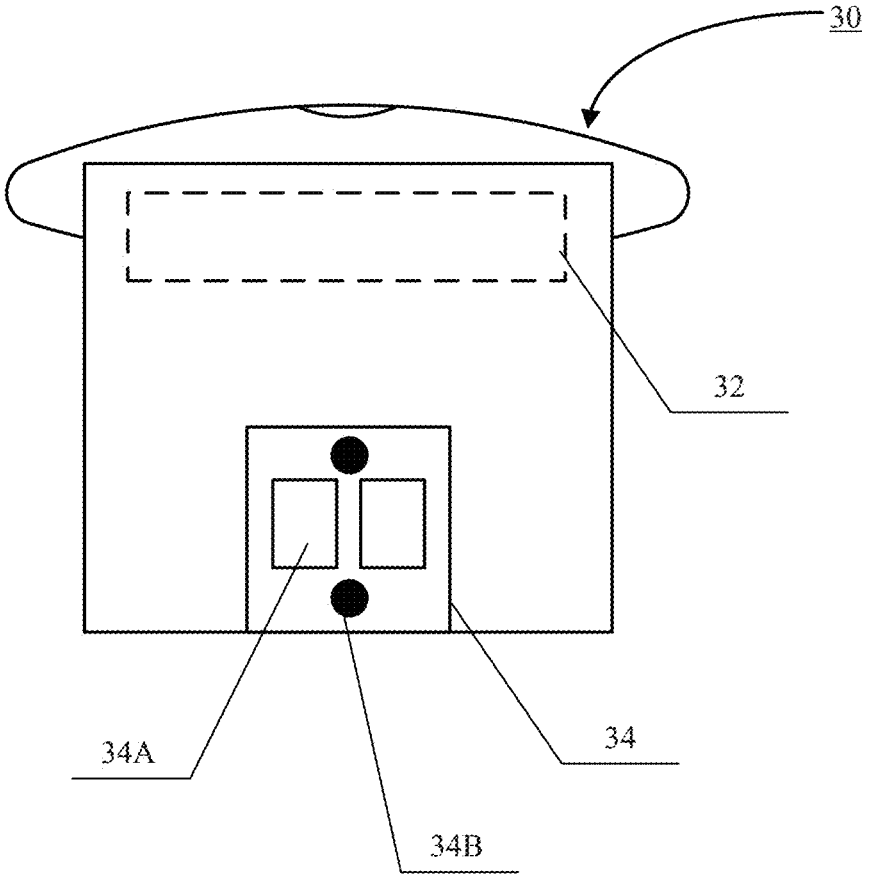
FIG. 7 is a schematic diagram illustrating a bottom of an electric fan frame, according to an exemplary embodiment of the present disclosure.

FIG. 7 is a schematic diagram illustrating an electric fan frame 30, according to an exemplary embodiment. For example, the electric fan frame 30 may be used in conjunction with power line assembly 20 shown in FIG. 6. Referring to FIG. 7, in addition to the components shown in FIG. 3, the power-receiving assembly 34 of the electric fan frame 30 may further include a second connection structure 34B.

When the power line assembly 20 is used to deliver power to electric fan frame 30, the first connection structure 26B may couple with the second connection structure 34B to affix the power line base 26 to the power-receiving assembly 34.

The coupling of the first connection structure 26B and the second connection structure 34B can prevent the electric fan frame 30 and the power line assembly 20 from being detached from each other easily. This way, power drop of the electric fan frame 30 due to accidents, such as the electric fan frame 30 being kicked unexpectedly, can be avoided.

Based on the above description, the technical solutions of the present disclosure also provide two power-delivery modes, namely an affixing mode and a touch mode, for using the power line assembly 20. The two power-delivery modes may be achieved by a power line base 26 that supports power delivery or has power-delivery contacts 26A on both the top surface 262 and bottom surface 264.

Referring to the example shown in FIG. 6, in the affixing mode, the power line base 26 may couple with the power-receiving assembly 34 of the electric fan frame 30 via the bottom surface 264, which contains both the first connection structure 26B and the power-delivery contacts 26A. As described before, the first connection structure 26B coupled with the second connection structure 34B can reliably combine, connect, and affix the electric fan frame 30 to the power line assembly 20, thereby avoiding accidental power drop of the electric fan frame 30.

Referring to the example shown in FIG. 2, in the touch mode, the power line base 26 may couple with the power-receiving assembly 34 via the top surface 262, which contains power-delivery contacts 26A but no first connection structure 26B. The top surface 262 and the power-receiving assembly 34 may form a simple surface contact with each other, but are not physically affixed. The power base assembly 26 and the power-receiving assembly 34 are effectively still two separate bodies. Therefore, a user may conveniently attach the electric fan frame 30 to the power line assembly 20 or detach the electric fan frame 30 from the power line assembly 20. This is helpful in simplifying the usage of electric fan frame 30.

The first connection structure 26B and the second connection structure 34B may couple with each other in various ways. In one embodiment, the first connection structure 26B and the second connection structure 34B may be coupled by magnetic attraction. For example, the first connection structure 26B may be made of magnet and the second connection structure 34B may be made of magnet or materials (e.g. metal such as iron, nickel, and the like) attractable by magnet. In another embodiment, the first connection structure 26B and the second connection structure 34B may be coupled via a mortise-and-tenon joint (e.g. a clamping or plug-in structure). The above coupling methods are for illustrative purpose only. The present disclosure does not limit the way of coupling the first connection structure 26A and the second connection structure 34B.

Figure 8:
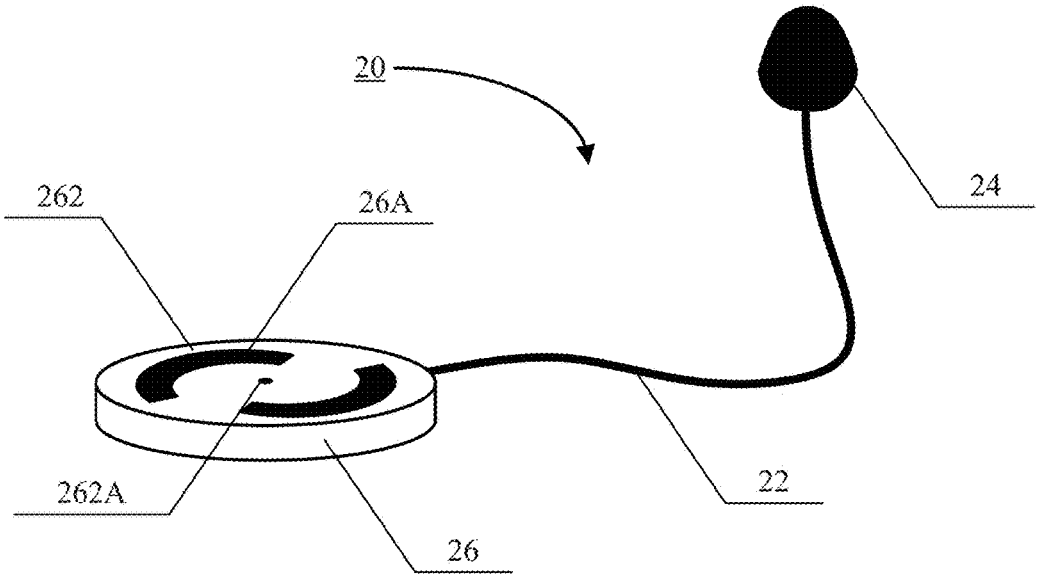
FIG. 8 is a schematic diagram illustrating a power line assembly, according to an exemplary embodiment of the present disclosure.

In the above description, the coupling between the power line assembly 20 and the electric fan frame 30 is described in the context of the power line base 26 having a cuboid shape. However, it is contemplated that the power line base 26 may have any possible shapes. FIG. 8 is a schematic diagram illustrating a power line assembly 20, according to an exemplary embodiment of the present disclosure. The power line base 26 shown in FIG. 8 is in a cylindrical shape. The rotation of the cylindrical power line base 26 may disturb the coupling between the power-delivery contacts 26A and the power-receiving contacts 34A, and thus may impose a high requirement for the relative positioning of the power-delivery contacts 26A and the power-receiving contacts 34A. To solve this problem, improvements may be made to the shape of either the power-delivery contacts 26A or the power-receiving contacts 34A, which is described below using the power-delivery contacts 26A as an example and in connection with FIG. 8.

Referring to FIG. 8, in a plan view, the power-delivery contacts 26A may be configured to have shapes of ring segments of predetermined lengths. The ring segments may have a circle center 262A coinciding with the center of the surface 262, on which the power-delivery contacts 26A are formed. For example, if the surface 262 is a circle, the "center" of the surface 262 is the circle center of the surface 262.

Figure 9:
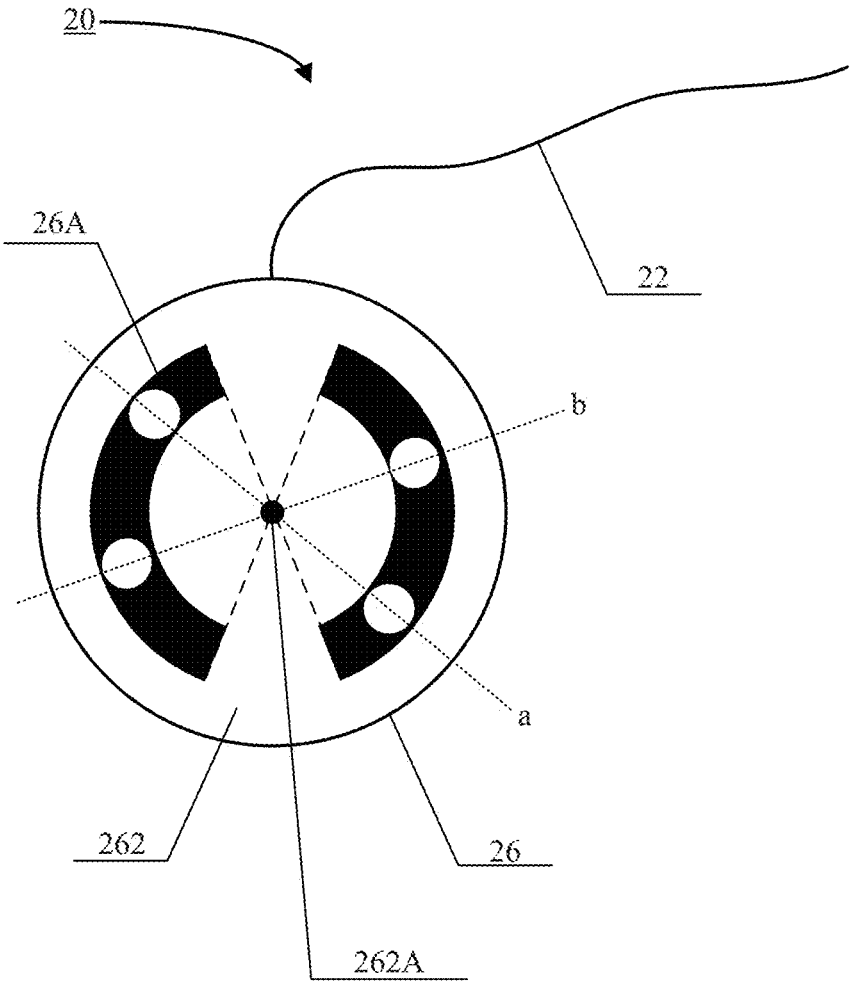
FIG. 9 is a schematic diagram illustrating coupling between a power line assembly and an electric fan frame, according to an exemplary embodiment of the present disclosure.

FIG. 9 is a schematic diagram illustrating coupling between the power line assembly 20 shown in FIG. 8 and an electric fan frame 30, according to an exemplary embodiment of the present disclosure. FIG. 9 shows a plan view of the power line base 26. Referring to FIG. 9, when the power line base 26 is coupled with the electric fan frame 30, the power-receiving contacts 34A may contact the surface 262 at contact points along a line labeled as "a". The contact points connected by line "a" lie within the area occupied by the power-delivery contacts 26A, and thus the contact between the power-receiving contacts 34A and the power-delivery contacts 26A can successfully supply power to the electric fan frames 30. When a relative rotation occurs between the power line base 26 and the electric fan frame 30, the contact points may move to be on a line labeled as "b." The contact points connected by line "b" still lie within the area occupied by the power-delivery contacts 26A due to the shape of ring segments. Thus, the power-receiving contacts 34A and the power-delivery contacts 26A may still contact with each other to achieve power supply. It can be seen that the ring segments may accommodate, to some extent, angle error and/or relative rotation in the coupling of the power line base 26 and the electric fan frame 30.

Similarly, the power-receiving contacts 34A may be modified to have shapes of ring segments of predetermined lengths. The ring segments may have a circle center coincide with the center of a coupling surface that corresponds to the power line base 26. Here, the "coupling surface" refers to the region on the bottom of the electric fan frame 30 which contacts with the power line base 26. The power-receiving contacts 34A shaped in ring segments tolerate the angle error and relative rotation for reasons similar to those discussed above, which will not be repeated herein.

Other embodiments consistent with the invention will be apparent to those skilled in the art from consideration of the specification and practice of the disclosures herein. This application is intended to cover any variations, uses, or adaptations of the disclosure following the general principles thereof and including such departures from the present disclosure as come within known or customary practice in the art. It is intended that the specification and embodiments be considered as illustrative only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the invention only be limited by the appended claims.

What is claimed is:

1. A power line assembly, comprising:

a power line;

a power plug disposed at a first end of the power line and configured to couple with a power outlet; and a power line base disposed at a second end of the power line and having a top surface and a bottom surface, each of the top and bottom surfaces having one or more power-delivery contacts, wherein one of the top surface and the bottom surface of the power line base includes a first connection structure configured to affix the power line base to a power-receiving assembly of an electronic device, wherein when the power line base couples with the power-receiving assembly, at least one of the power-delivery contacts contacts with a power-receiving contact of the power-receiving assembly, to deliver power to the electronic device, wherein the power line assembly supports two power-delivery modes comprising an affixing mode and a touch mode, wherein in the affixing mode, the first connection structure on the one of the top surface and the bottom surface of the power line base affixes the power line base to the power-receiving assembly, by coupling with a second connection structure of the power-receiving assembly, and in the touch mode, at least one power-delivery contact on the other one of the top surface and the bottom surface of the power line base contacts with the power-receiving contact of the power-receiving assembly, without affixing the power line base to the power-receiving assembly.

2. The power line assembly of claim 1, wherein the first connection structure is a magnetic structure configured to couple with the second connection structure by magnetic attraction.

3. The power line assembly of claim 1, wherein the first connection structure is configured to couple with the second connection structure via a mortise-and-tenon joint.

4. An electronic device for use with a power line assembly, the electronic device comprising:

a battery; and a power-receiving assembly comprising:

a power-receiving contact, and a first connection structure configured to affix the power-receiving assembly to a power line base of the power line assembly by coupling with a second connection structure located on a first surface of the power line base, the first surface being a top surface or a bottom surface of the power line base, wherein when the power-receiving assembly is coupled with the power line base, the power-receiving contact contacts with at least one power-delivery contact located on the power line base, to receive power from the power line assembly, wherein the power line assembly supports two power-delivery modes comprising an affixing mode and a touch mode, in the affixing mode, the first connection structure affixes the power line base to the power-receiving assembly, by coupling with the second connection structure on the first surface of the power line base, and in the touch mode, at least one power-delivery contact on a second surface of the power line base contacts with the power-receiving contact of the power-receiving assembly, without affixing the power line base to the power-receiving assembly.

5. The electronic device of claim 4, wherein the first connection structure is a magnetic structure configured to couple with the second connection structure by magnetic attraction.

6. The electronic device of claim 4, wherein the first connection structure is configured to couple with the second connection structure via a mortise-and-tenon joint.

7. The electronic device of claim 4, wherein a bottom of the electronic device is recessed to form an accommodation space for receiving the power line base, and the power-receiving assembly is disposed on a ceiling of the accommodation space.

8. The electronic device of claim 4, wherein the electronic device is an electric fan.

9. An electronic device for use with a power line assembly, the electronic device comprising:

a battery; and a power-receiving assembly comprising:

a power-receiving contact, and a first connection structure, wherein the power-receiving assembly is configured to couple with a power line base of the power line assembly;

when the electronic device is operated in an affixing mode, the first connection structure affixes the power-receiving assembly to the power line base by coupling with a second connection structure formed on a first surface of the power line base, wherein the power-receiving contact contacts with a power-delivery contact on the first surface of the power line base to receive power from the power line assembly; and when the electronic device is operated in a touch mode, the power-receiving assembly contacts with a second surface of the power line base, without being affixed to the power-receiving assembly, to connect the power-receiving assembly and the power line base, wherein the power-receiving contact contacts with a power-delivery contact on the second surface of the power line base to receive power from the power line assembly.

* * * * *